US006575505B1

(12) United States Patent
Dimig

(10) Patent No.: US 6,575,505 B1
(45) Date of Patent: Jun. 10, 2003

(54) LATCH APPARATUS AND METHOD

(75) Inventor: Steven J. Dimig, Plymouth, WI (US)

(73) Assignee: Strattec Security Corporation, Milwaukee, WI (US)

( * ) Notice: Subject to any disclaimer, the term of this patent is extended or adjusted under 35 U.S.C. 154(b) by 0 days.

(21) Appl. No.: 09/695,791

(22) Filed: Oct. 25, 2000

(51) Int. Cl.[7] ..... E05C 3/06
(52) U.S. Cl. ..... 292/216; 292/DIG. 23
(58) Field of Search ..... 292/216, 201, 292/DIG. 23; 70/264

(56) References Cited

U.S. PATENT DOCUMENTS

| | | | |
|---|---|---|---|
| 1,611,838 | A | 12/1926 | Malicki |
| 2,802,357 | A | 8/1957 | Smith |
| 2,910,859 | A | 11/1959 | Allen et al. |
| 2,955,864 | A | 10/1960 | Van Voorhees |

(List continued on next page.)

FOREIGN PATENT DOCUMENTS

| | | |
|---|---|---|
| DE | 355578 | 1/1921 |
| DE | 538812 | 11/1929 |
| DE | 685943 | 12/1939 |
| DE | 4129706 | 3/1993 |
| DE | 19527565 | 1/1997 |
| DE | 29701390 | 11/1997 |
| EP | 0169644 | 1/1986 |
| EP | 285412 | 5/1988 |
| EP | 0694665 | 1/1996 |
| EP | 0743413 | 11/1996 |
| FR | 2746840 | 10/1997 |
| GB | 5427 | 3/1911 |
| GB | 1563368 | 3/1980 |
| GB | 2034801 | 6/1980 |
| IT | 413637 | 5/1946 |
| WO | WO90/0582 | 5/1990 |
| WO | WO00/20710 | 4/2000 |

*Primary Examiner*—Gary Estremsky
(74) *Attorney, Agent, or Firm*—Michael Best & Friedrich LLP

(57) ABSTRACT

The present invention includes a pawl releasably engagable with a ratchet, a handle connected directly or indirectly to a user-manipulatable device, a cam movable between an unlocked position in which actuation of the cam by the handle generates sufficient pawl movement to release the ratchet and a locked position in which actuation of the cam by the handle does not generate sufficient pawl movement to release the ratchet, and a lock coupled to the cam for moving the cam between its unlocked and locked positions. The cam has at least one cam surface that, when the cam is moved by the lock toward its unlocked position, cams against one or more surfaces of the pawl, the handle, or the pawl and the handle if the handle is already partially or fully actuated. In some highly preferred embodiments, the cam is movable within an aperture in the pawl, an aperture in the handle, or apertures in the pawl and handle. The apertures can function to guide the cam in its motion between unlocked and locked positions and also to provide cam surfaces against which the cam cams to transmit motion to the pawl.

42 Claims, 9 Drawing Sheets

U.S. PATENT DOCUMENTS 3,121,580 A 2/1964 Di Salvo et al.
3,563,589 A * 2/1971 Kwasiborski ..... 292/216
3,767,242 A 10/1973 Quantz
3,858,919 A * 1/1975 Kleefeld ..... 292/216
3,889,501 A 6/1975 Fort
4,056,276 A 11/1977 Jarvis
4,097,077 A * 6/1978 Gahrs ..... 292/216
4,289,342 A 9/1981 Bemm et al.
4,386,798 A 6/1983 Ménard
4,518,180 A 5/1985 Kleefeldt et al.
4,617,812 A 10/1986 Rogers
4,637,239 A 1/1987 Kleefeldt et al.
4,656,850 A 4/1987 Tabata
4,824,152 A 4/1989 Jeavons
4,887,390 A 12/1989 Boyko et al.
4,948,183 A 8/1990 Yamada
4,986,098 A 1/1991 Fisher
4,995,248 A 2/1991 Liu
5,029,915 A 7/1991 Wilkes
5,037,145 A 8/1991 Wilkes
5,046,377 A 9/1991 Wilkes et al.
5,074,603 A 12/1991 Brackmann
5,142,890 A 9/1992 Uyeda et al.
5,236,234 A 8/1993 Norman
5,307,656 A 5/1994 Gartner et al.
5,308,128 A 5/1994 Portelli et al.
5,350,206 A 9/1994 Akahori et al.
5,423,582 A 6/1995 Kleefeldt
5,531,488 A 7/1996 Yoshikuwa et al.
5,538,298 A 7/1996 Ikeda
5,547,208 A 8/1996 Chappell et al.
5,561,997 A 10/1996 Milman
5,577,782 A 11/1996 Johnson et al.
5,603,539 A 2/1997 Gruhn et al.
5,636,880 A 6/1997 Miller et al.
5,676,003 A 10/1997 Ursel et al.
5,697,236 A 12/1997 Kleefeldt et al.
5,722,272 A 3/1998 Bridgeman et al.
5,727,825 A 3/1998 Spurr
5,732,988 A 3/1998 Mizuki
5,758,912 A 6/1998 Hamada
5,765,884 A 6/1998 Armbruster
5,769,468 A 6/1998 Armbruster
5,785,364 A 7/1998 Kleefeldt et al.
5,803,515 A * 9/1998 Arabia ..... 292/216
5,844,470 A 12/1998 Garnault et al.
5,881,589 A 3/1999 Clark et al.
5,901,991 A 5/1999 Hugel et al.
5,921,594 A 7/1999 Bendel
5,921,595 A 7/1999 Brackmann et al.
5,931,034 A 8/1999 Fisher
6,050,620 A * 4/2000 Rogers ..... 292/216
6,062,613 A 5/2000 Jung et al.
6,079,237 A 6/2000 Hochart
6,254,148 B1 7/2000 Cetnar
6,126,212 A * 10/2000 Fujihara ..... 292/216
6,148,651 A 11/2000 Roncin
6,168,215 B1 1/2001 Kodama et al.
6,286,878 B1 9/2001 Hochart et al.
6,338,508 B1 * 1/2002 Kleefeldt ..... 292/201

* cited by examiner

LATCH APPARATUS AND METHOD

FIELD OF THE INVENTION

The present invention relates to latches and latching methods, and more particularly to devices and methods for controlling and switching a latch between latched and unlatched states.

BACKGROUND OF THE INVENTION

Conventional latches are used to restrain the movement of one member or element with respect to another. For example, conventional door latches restrain the movement of a door with respect to a surrounding door frame. The function of such latches is to hold the door secure within the door frame until the latch is released and the door is free to open. Existing latches typically have mechanical connections linking the latch to actuation elements such as handles which can be actuated by a user to release the latch. Movement of the actuation elements is transferred through the mechanical connections and (if not locked) can cause the latch to release. The mechanical connections can be one or more rods, cables, or other suitable elements or devices. Although the following discussion is with reference to door latches (e.g., especially for vehicle doors) for purposes of example and discussion only, the background information and the disclosure of the present invention provided applies equally to a wide variety of latches used in other applications.

Most current vehicle door latches contain a restraint mechanism for preventing the release of the latch without proper authorization. When in a locked state, the restraint mechanism blocks or impedes the mechanical connection between a user-operable handle (or other door opening device) and a latch release mechanism, thereby locking the door. Many conventional door latches also have two or more lock states, such as unlocked, locked, child locked, and dead locked states. Inputs to the latch for controlling the lock states of the latch can be mechanical, electrical, or parallel mechanical and electrical inputs. For example, by the turn of a user's key, a cylinder lock can mechanically move the restraint mechanism, thereby unlocking the latch. As another example, the restraint mechanism can be controlled by one or more electrical power actuators. These actuators, sometimes called "power locks" can use electrical motors or solenoids as the force generator to change between locked and unlocked states.

Regardless of the mechanism employed to change the locked state of a latch assembly (to disable or enable a mechanical or electrical input to the latch assembly), a problem common to the vast majority of conventional door latches relates to the inability of such door latches to properly respond to multiple inputs at a given time. A well-recognized example of this problem is the inability of most conventional door latches to properly respond to a user unlocking the door latch while the door handle is partially or fully actuated. While this problem can exist for door latches that are not powered, it is particularly problematic in powered latches. For example, a user of a keyless entry system can push a button on a key fob, enter an access code on a door keypad, or otherwise transmit a signal (by wire or wirelessly) to a controller in the vehicle that in turn sends a signal to power unlock a handle input to the latch. In conventional power latches, an amount of time is required for this process to take place. During this time, a user may attempt to unlatch the latch by actuating the handle input.

Because the latch has not yet been unlocked, such actuation does nothing—even though the latch is attempting to power itself to its unlocked state while the handle input is in a partially or fully actuated position. The user must release and re-actuate the handle to unlatch the latch. In other words, to unlatch a conventional latch, actuation of the handle input must occur after the handle input has been placed in its unlocked state. Partial or full actuation of the handle input before this time will not unlatch the latch and will require the user to release and re-actuate the handle input.

This shortcoming of conventional door latches exists for powered and fully manual door latches alike. In addition to requiring the user to re-actuate an input to unlatch the unlocked latch, this problem can even prevent the latch from changing between its locked and unlocked states. In such a case, the user is required to unlock the latch assembly again (re-transmit a signal to the latch assembly or manually unlock the latch assembly again as described above) after the handle input has been released. Any of the results just described represent an annoying attribute of conventional latch assembly designs. In this and other examples, a conventional latch assembly is unable to respond to actuation of more than one input at a time, or is only responsive to one of two inputs actuated simultaneously or closely in time.

It is possible to add structure and elements to conventional door latch designs in order to address the above-noted problems. However, such additional structure and elements are likely to increase latch complexity. Increased latch complexity also increases assembly and repair cost. Accordingly, the reasonable door latch design alternatives available to address the above-noted problems of conventional door latches are significantly limited.

Problems of latch weight and size are related to the problem of latch complexity. The inclusion of more elements and more complex mechanisms within the latch generally undesirably increases the size and weight of the latch. In virtually all vehicle applications, weight and size of any component is a concern. Therefore, many latch designs employing additional structure and elements to address the above-noted problems do so at an unacceptable cost of increased latch weight and size.

In light of the problems and limitations of the prior art described above, a need exists for a latch assembly which is able to properly respond to an unlocking/locking input and to a latching/unlatching input received simultaneously or closely in time, does so with minimal to no additional latch assembly elements and structure, does not negatively impact latch complexity and cost, and can be achieved by relatively simple modification of many existing latch assembly designs. Each preferred embodiment of the present invention achieves one or more of these results.

SUMMARY OF THE INVENTION

The latch assembly of the present invention is capable of properly responding to unlatching and unlocking inputs received at the same time or closely in time. In other words, when an unlatching input is received before or while an associated locking mechanism is placed in its unlocked state, the latch assembly properly responds by unlatching the latch upon movement of the locking mechanism to the unlocked state. In one preferred application involving a car door latch capable of being unlocked via a remote keyless entry system, the user can partially or fully actuate the door handle prior to unlocking the door or while the door is being unlocked (e.g., while the keyless entry system is still processing the request to unlock the latch assembly, during movement of the locking mechanism to its unlocked state, and the like). The latch assembly responds by unlatching the latch when the latch assembly is finally unlocked, and does so without requiring the user to release and re-actuate the door handle.

Some preferred embodiments of the present invention include a pawl releasably engagable with a ratchet latching the door in place, a user-manipulatable handle, a cam movable between an unlocked position (in which actuation of the cam by the handle generates sufficient pawl movement to release the ratchet) and a locked position (in which actuation of the cam by the handle does not generate sufficient pawl movement to release the ratchet), and a lock coupled to the cam for moving the cam between its unlocked and locked positions. In some highly preferred embodiments of the present invention, the lock is jointed to provide compound movement of the cam between its unlocked and locked positions.

The cam preferably has at least one cam surface that, when the cam is moved by the lock toward its unlocked position, cams against one or more surfaces of the pawl, the handle, or both the pawl and the handle if the handle is already actuated (fully, partially to any extent and/or partially to at least some minimum extent). To provide for smoother camming motion, cam surfaces of the cam, pawl, and handle are preferably brought together at a relatively shallow angle. Also for this same purpose, these surfaces are preferably beveled, blunted, bowed, chamfered, rounded, sloped, or otherwise shaped to present at least a portion of each surface at a relatively shallow angle with respect to the opposing cam surface. Preferably, if the handle has not yet been actuated, the cam can be moved between its unlocked and locked positions without camming action against the pawl or handle or at least with minimal camming action.

In some highly preferred embodiments of the present invention, the cam is movable within an aperture in the pawl, an aperture in the handle, or apertures in both the pawl and handle. For example, the cam can be movable by the lock through an aperture in the handle into and out of a position adjacent to the pawl in which actuation of the handle forces the cam against the pawl and thereby causes the pawl to move toward its unlatched position. The lock in this case can move the cam into camming contact with the pawl (to move the pawl toward its unlatched position) even after partial or full actuation of the handle. The handle aperture in this example can function to guide the cam in its motion between its unlocked and locked positions and can also provide a surface to press or cam against the cam which in turn cams against the pawl. As another example, the cam can be movable within apertures in the handle and the pawl. When the handle is partially or fully actuated, the apertures become misaligned. Upon movement of the cam into and/or through the apertures, the cam cams against a surface of the pawl aperture (and preferably also against a surface of the handle aperture) to re-align the pawl and handle apertures and to thereby move the pawl toward its unlatched position.

In various alternative embodiments, the cam can be movable into and out of pawl and/or handle apertures by actuation of the lock. As used herein and in the appended claims, the term "aperture" includes any type of hole, cavity, orifice, recess, groove, slot, or other opening. The "aperture" can be closed to the sides of the element in which it is defined or can be open to such sides. For example, the aperture can be a cavity located within the pawl or handle or can be a notch or recess in a side of the pawl or handle. The aperture may or may not extend fully through the element in which it is defined.

In still other alternative embodiments, the lock is rotatably connected to the pawl, whereby the cam instead cams against a cam surface of the handle if the handle has already been partially or fully actuated. This camming motion transmits rotational force to the pawl to move the pawl toward its unlatched position.

In most highly preferred embodiments of the present invention, movement of the cam (by actuation of the lock) to an unlocked position while the handle is in an actuated position as described above brings the cam into camming engagement with the pawl, the handle, or with both the pawl and the handle. This camming engagement transmits motive force to the pawl to move the pawl toward its unlatched position. The term "motive force" as used herein and in the appended claims means that force is transferred that is sufficient to generate motion of an element.

Because most conventional latch assemblies include a pawl, a handle, and a lock of some type, the present invention typically does not involve any significant addition of elements or latch assembly structure. Also, existing latch assembly designs can often be easily modified to operate in accordance with the present invention. Therefore, the present invention has little to no negative impact upon latch weight, complexity, and assembly and repair cost, and provides significant advantages over conventional latch assembly designs.

More information and a better understanding of the present invention can be achieved by reference to the following drawings and detailed description.

BRIEF DESCRIPTION OF THE DRAWINGS

The present invention is further described with reference to the accompanying drawings, which show preferred embodiments of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention.

In the drawings, wherein like reference numerals indicate like parts.

DETAILED DESCRIPTION OF THE PREFERRED EMBODIMENTS

The latch assembly of the present invention (indicated generally at 10, 110, and 210 in FIGS. 1–5, 6–10, and 11–15 of the three illustrated preferred embodiments) is described hereinafter with reference to use in a vehicle door application. However, it should be noted that the latch assembly 10, 110, 210 can instead be used in many other applications. The present invention can be used in any application in which it is desirable to releasably secure one body to another. Such applications can be non-automotive and need not involve doors.

In most vehicle door latch applications, a latch will have a connection to an inside door handle, an outside door handle, an inside lock, and possibly an outside lock (e.g., usually for front doors of a vehicle). Each of these connections represents an input to the latch. Typically, latch inputs are operable either to generate latch release or to enable or disable such an input. Inputs for generating latch release usually run from a user-manipulatable device such as a lever inside or outside of the vehicle. Inputs for enabling and disabling these latch release inputs can also run from a user-manipulatable device inside or outside of the vehicle, such as a lock cylinder, a sill button, an electrical controller or user-operable electronic device such as a keypad or remote access electronic system connected to the latch assembly, and the like. Regardless of what mechanical or electrical controls are employed to control and trigger latching, unlatching, and latch input enabling and disabling, virtually every vehicle latch has a mechanism for ultimately perform these functions. Three examples of these latch assemblies are shown in FIGS. 1–5, 6–10, and 11–15, respectively.

Figure 16:
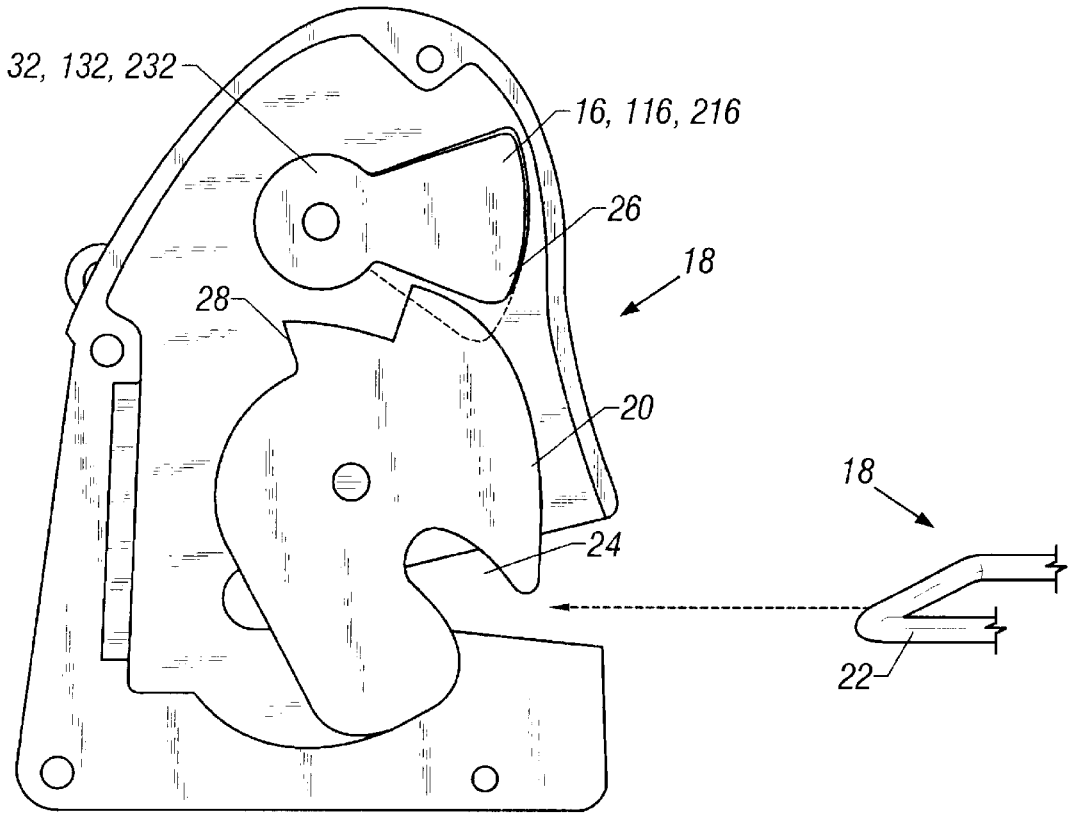
FIG. 16 is a perspective view of a ratchet and a driving portion of the pawl shown in each of FIGS. 1–15.

With reference to FIG. 16, conventional vehicle door latches almost invariably employ a ratchet and striker mechanism 18 to latch a door in its closed position. In such a mechanism, the ratchet 20 and striker 22 releasably engage one another, and can be mounted in any conventional manner on a door and its respective door jam for movement relative to one another. For example, the striker 22 can be mounted upon a door jam, while the latch and ratchet 20 can be mounted on a vehicle door movable to a closed position in which the striker 22 enters an aperture 24 in the ratchet 20 and is trapped therein upon resulting movement of the ratchet 20. Alternatively, the striker 22 can be mounted upon the vehicle door, while the latch and ratchet 20 are mounted upon the door jam. In either case, the ratchet 20 is typically movable between a latched position in which the striker 22 is trapped in the ratchet aperture 24 and an unlatched position in which the striker 22 is free to exit the ratchet aperture 24. This ratchet movement can be (and typically is) rotational, whereby the ratchet 20 is mounted to rotate about a pivot. However, other forms of ratchet movement are possible. To capture the striker 22, the ratchet 20 usually cooperates with the latch housing (not shown) so that the striker 22 is captured by the walls of the ratchet aperture 24 and by a wall or other portion of the latch housing when the ratchet 20 is in its latched position. It should be noted that other forms of striker capture are also possible, and need not necessarily employ purely rotational ratchet movement or any type of rotational ratchet movement. Also, the shape of the ratchet and striker can vary significantly while still performing the function of releasably capturing the striker 22 via movement of the ratchet when engaged therewith. One having ordinary skill in the art will recognize that many different striker and ratchet designs and arrangements are possible.

Regardless of how the ratchet 20 moves and how it captures the striker 22, conventional latches typically employ a pawl that cooperates with the ratchet 20 to hold the ratchet 20 in a particular position or state. Most commonly, the ratchet 20 is releasably engagable by the pawl to hold the pawl in its latched state. Although such an arrangement is described hereinafter, it should be noted that the pawl can be releasably engagable with the ratchet 20 to hold the ratchet 20 in its unlatched state in less common latch arrangements. One pawl design is shown in FIG. 16 by way of example only. In FIG. 16, only a portion of the pawl 16, 116, 216 is shown (the driving portion interacting with the ratchet 20). Different examples of the remainder (driven portion) of the pawl 16, 116, 216 are shown in FIGS. 1–5, 6–10, and 11–15, respectively. Like the driving portion of the pawl 16, 116, 216, the driven portion of the pawl 16, 116, 216 shown in FIGS. 1–15 can take a number of different shapes. The shape of the driven portion of the pawl 16, 116, 216 is dependent at least partially upon the element or mechanism employed to move the pawl 16, 116, 216. One having ordinary skill in the art will appreciate that numerous examples of such elements and mechanisms exist in the art and can be employed in conjunction with the present invention as described in greater detail below.

With reference again to FIG. 16, the pawl 16, 116, 216 is pivotable into and out of engagement with the ratchet 20, and has an engagement portion 26 that obstructs movement of the ratchet 20 to its unlatched position by engagement with a step 28 on the ratchet 20. In another example, the pawl 16, 116, 216 is pivotable into and out of engagement with a lip, ledge, peg, abutment, boss, tooth, or other element or feature of the ratchet 20. Because the ratchet 20 is typically spring-loaded toward its unlatched position, disengagement of the pawl 16, 116, 216 from the ratchet 20 permits the ratchet 20 to move and to thereby release the striker 22. Rotation of the pawl 16, 116, 216 therefore generates striker release. Like the ratchet 20, the pawl 16, 116, 216 can take any form capable of releasably engaging with the ratchet 20 to selectively limit ratchet movement.

Although other conventional forms of pawl movement (e.g., translation or a combination of sliding and translation) to engage and disengage the ratchet 20 are possible and fall within the spirit and scope of the present invention, pawl rotation is most common. Accordingly, and with reference to the illustrated preferred embodiments of the present invention, rotation of the pawl 16, 116, 216 is preferably performed to disengage the ratchet 20 and thereby to unlatch the latch.

As shown in the figures, each latch assembly 10, 110, 210 has a lock lever (hereafter referred to as "lock"), 12, 112, 212, a handle lever (hereafter referred to as "handle"), 14, 114, 214, and a pawl 16, 116, 216. The handle 14, 114, 214 and lock 12, 112, 212 are both directly or indirectly connected to conventional mechanical, electrical, or electromechanical devices (latch "inputs" discussed above) that are manipulatable or operable by a user to actuate the handle 14, 114, 214 and lock 12, 112, 212, respectively. Each of the latch assembly embodiments of FIGS. 1–5, 6–10, and 11–15 are shown with only one lock 12, 112, 212 and one handle 14, 114, 214 for ease of description and for purposes of illustration only. Any of these embodiments can instead have any number of locks 12, 112, 212 and handles 14, 114, 214 with any number of corresponding latch inputs connected thereto for actuation thereof. In this regard, the lock 12, 112, 212 and handle 14, 114, 214 can be connected for actuation to any number of latch inputs for actuation thereby.

In application of the present invention, it should be noted that the "handle", "pawl", and "lock" illustrated and described herein can, in some embodiments, include additional elements. For example, the handle 14, 114, 214 in many applications would normally also include one or more elements connected to a user-manipulatable device such as a lever mounted on the vehicle for user actuation of the handle 14, 114, 214. As another example, the lock 12, 112, 212 in many applications would normally also include one or more elements connected to a user-manipulatable device such as a lock cylinder, an actuator and associated power lock controls, etc. As yet another example, the pawl 16, 116, 216 could be defined by two or more elements connected together in any conventional manner. Accordingly, the terms "handle", "pawl", and "lock" as used herein and in the appended claims include latch assemblies having such additional elements and latch assemblies not having such additional elements.

A number of elements which are likely to be found in a latch in conjunction with the latch assembly 10, 110, 210 of the present invention are not essential for the present invention and are not therefore described further herein or shown in FIGS. 1–16. For example, although not necessary to the present invention, the latch assembly 10, 110, 210 is normally at least partially enclosed within a housing (not shown). As another example, the lock 12, 112, 212, handle 14, 114, 214, and pawl 16, 116, 216 of each illustrated preferred embodiment are preferably biased by springs (also not shown) in any conventional manner toward respective positions within the latch and preferably have one or more stops, walls, or surfaces (also not shown) limiting the range of motion of these elements.

A first preferred embodiment of the present invention is illustrated in FIGS. 1–5. The pawl 16 is mounted in any conventional manner for rotation about a pawl pivot 30 which can be integral with the pawl 16, coupled to the pawl 16 for rotation therewith or received within mating apertures in the latch (in the latch housing, in bosses or posts extending from the latch housing, and the like). Most preferably, the driven portion 32 of the pawl 16 is integral with or is coupled to the driving portion 34 of the pawl 16 via the pawl pivot 30. The lock 12 of the latch assembly 10 is preferably also mounted in any conventional manner for rotation about a pivot 48 which can be integral with the lock 12, coupled to the lock 12 for rotation therewith or received within mating apertures in the latch as described above with reference to the pawl pivot 30.

In highly preferred embodiments of the present invention such as that shown in FIGS. 1–5, the lock 12 is a jointed member, wherein a first portion 36 of the lock 12 is mounted for pivotal movement via the pivot 48 as described above and wherein a second portion 38 is pivotably connected to the first portion 36. The first and second portions 36, 38 of the lock 12 can be pivotably connected in any conventional manner, such as by a pivot 40 as shown in FIGS. 1–5, a ball joint, a hinge joint, and the like.

The handle 14 is preferably mounted in any conventional manner for rotation with respect to the pawl 16 and lock 12. Although the handle 14 can be mounted for rotation about a dedicated pivot in any of the manners described above with reference to the pawl 16 and lock 12, the handle 14 is more preferably mounted for rotation about the pawl pivot 30 as shown in FIGS. 1–5. Accordingly, the pawl pivot 30 can be an extension of the handle 14, if desired. The handle 14 has an aperture 42 that is preferably elongated in shape. A cam 44 extending from the lock 12 is received within the aperture 42 and is movable therein for purposes to be described below. In those highly preferred embodiments of the present invention where an articulated lock 12 is employed as described above, the cam 44 preferably extends from the second portion 38 of the lock 12. The cam 44 is preferably integral with the lock 12, but can be a separate element connected thereto in any conventional manner. Most preferably, the cam 44 is in the shape of a post, pin, or rod extending from the lock 12 into the aperture 42 in the handle 14 for movement therein. Other cam shapes capable of being received within the handle aperture 42 and capable of movement therein can instead be used as desired.

Figure 1:
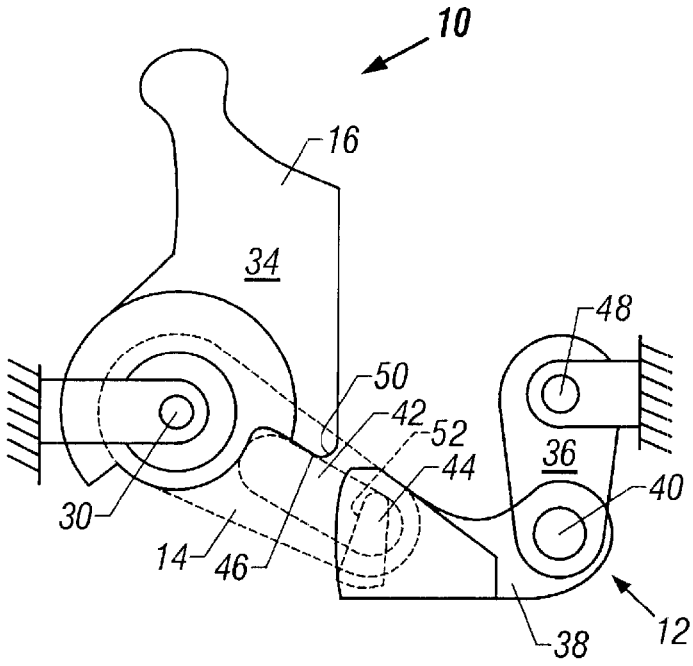
FIG. 1 is an elevational view of a latch assembly according to a first preferred embodiment of the present invention, shown with the latch assembly in a locked state and with the handle in an unactuated position.
Figure 2:
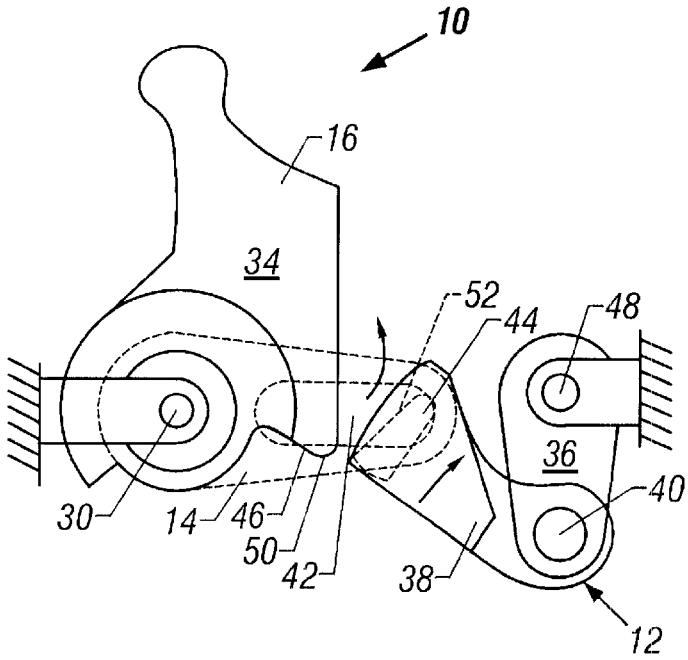
FIG. 2 is an elevational view of the latch assembly illustrated in FIG. 1, shown with the latch assembly in a locked state and with the handle in an actuated position.
Figure 3:
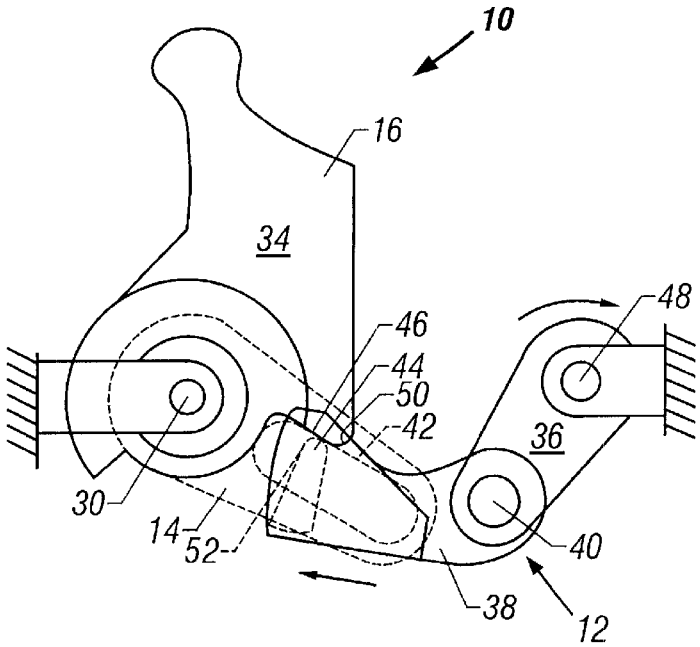
FIG. 3 is an elevational view of the latch assembly illustrated in FIGS. 1 and 2, shown with the latch assembly in an unlocked state and with the handle in an unactuated position.
Figure 4:
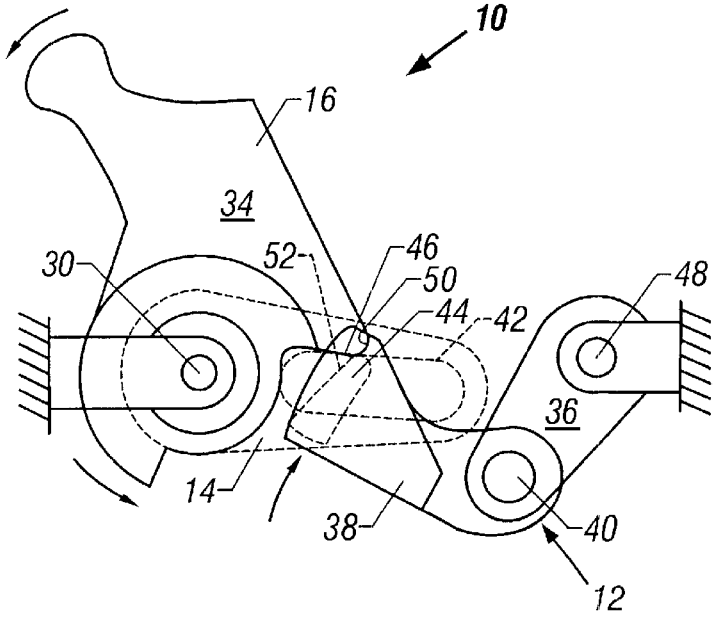
FIG. 4 is an elevational view of the latch assembly illustrated in FIGS. 1–3, shown with the latch assembly in an unlocked state and with the handle in an actuated position.

The latch assembly 10 has a locked state and an unlocked state. The locked state of the latch assembly is shown in FIGS. 1 and 2, while the unlocked state is shown in FIGS. 3 and 4. In either state, actuation of the handle 14 preferably causes the handle 14 to pivot about pivot 30. Because the cam 44 is received within the handle aperture 42, the cam 44 and the lock 12 to which it is connected are caused to move as shown in FIG. 2 when the latch assembly 10 is in the locked state. Specifically, the second portion 38 of the lock 12 preferably pivots about lock pivot 40, carrying the cam 44 with it through a curved path. This motion does not generate movement of the pawl 16 because the path traveled by the cam 44 is a distance from the pawl 16. Therefore, in this locked state of the latch assembly 10, the first portion 36 of the lock 12 is rotated to a position where the second portion 38 of the lock 12 is removed from the pawl 16.

To unlock the latch assembly 10, the first portion 36 of the lock 12 is rotated to bring the second portion 38 of the lock 12 into operative relation with respect to the pawl 16. In particular, the second portion 38 of the lock 12 and the cam 44 extending therefrom are brought to a position in which the cam 44 can subsequently be moved into contact with the pawl 16. This unlocked position is illustrated in FIG. 3.

Because the cam 44 is received within the handle aperture 42, actuation of the handle 14 causes the cam 44 and the lock 12 to which it is connected to move as shown in FIG. 4. Specifically, the second portion 38 of the lock 12 preferably pivots about lock pivot 40, carrying the cam 44 with it through a curved path into contact with a surface 46 of the pawl 16. Further actuation of the handle 14 causes the cam 44 to move the pawl 16. This force transmission is made possible by trapping the cam 44 between a surface of the handle aperture 42 within which the cam 44 is received and a surface 46 of the pawl 16 against which the cam 44 is moved. The pawl 16 is therefore preferably pivoted about pivot 30, which generates release of the ratchet 20. In addition to providing a force transmitting surface to move the pawl 16 as just described, the handle aperture 42 preferably also functions to guide the cam 44 between its locked and unlocked positions shown in FIGS. 1–2 and 3–4, respectively. For this purpose, the handle aperture 42 is preferably elongated, but can instead be any shape desired that is capable of permitting the cam 44 to move to and from a position in which an aperture wall preferably transmits motive force to the cam 44 to move the pawl 16.

To move the lock 12 between its locked and unlocked positions, the lock 12 is preferably driven for rotation about the pivot 48 in any conventional manner. For example, the pivot 48 can be rotated by a motor (directly or indirectly), can be rotated by an actuator coupled to a moment arm of the pivot 48, and the like. Alternatively, the lock 12 can be connected to and be directly actuated by any conventional actuator, electromagnet set, or other actuating device for pivotal movement about the pivot 48.

Figure 5:
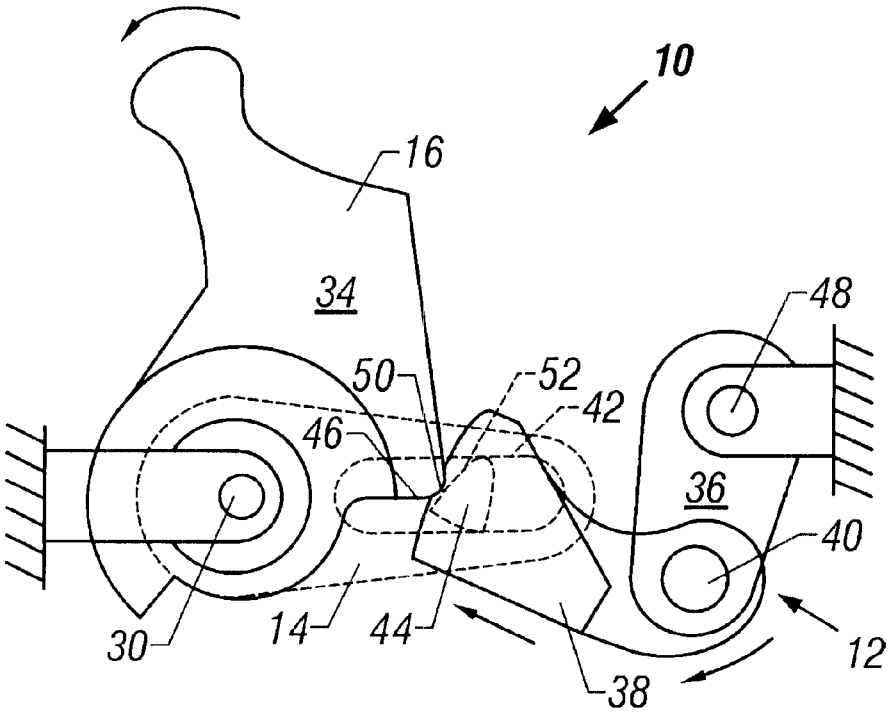
FIG. 5 is an elevational view of the latch assembly illustrated in FIGS. 1–4, shown with the handle in an actuated position and with the pawl being cammed toward its unlatched position.

With reference to FIG. 5 of the first preferred embodiment, the latch assembly 10 of the present invention can properly respond to actuation of the lock 12 toward its unlocked position after the handle 14 has been actuated. When the handle 14 is first actuated as shown in FIG. 2, subsequent actuation of the lock 12 toward its unlocked position brings the cam 44 into contact with the pawl 16 as shown in FIG. 5. The pawl 16 has a surface 50 against which the cam 44 moves as the lock 12 is moved to its unlocked position. This motion is a camming motion, and is enabled by sloped shapes of the pawl surface 50 and cam surface 52 brought into contact with one another when the handle 14 and lock 12 are both in actuated positions. The cam 44 cams against the pawl 16 and thereby forces the pawl 16 to move toward its unlatched position. When a user actuates a locked door handle 14, the lock 12 will therefore unlatch the latch upon being actuated to its unlocked position, and does so without requiring the user to release and re-actuate the handle 14.

As will be described in more detail below, the camming motion of the cam 44 against the pawl 16 need not necessarily occur only when the handle 14 has been fully actuated. Specifically, the handle 14 and pawl 16 can be relatively positioned such that partial actuation of the handle 14 places the cam 44 into a position where subsequent partial or full actuation of the lock 12 moves the pawl 16 to its unlatched position. Also, the camming motion of cam 44 against the pawl 16 does not necessarily require the handle 16 to be actuated (partially or fully) before the lock 12 is moved toward its unlocked position. In some embodiments of the present invention for example, actuation of the handle 14 simultaneously with movement of the lock 12 to its unlocked position can generate movement of the pawl 16 via the camming motion described above. In these or other embodiments, such camming motion to release the pawl 16 can occur after the lock 12 has begun to move to its unlocked position prior to partial or full actuation of the handle 14.

The camming action between the cam 44 and the pawl 16 is preferably a sliding motion of pawl and cam surfaces 50, 52 against one another. At least a portion of these surfaces 50, 52 are preferably brought together at a shallow angle with respect to one another to better enable the camming action. The surfaces 50, 52 can therefore be beveled, blunted, bowed, chamfered, rounded, or sloped as shown in FIGS. 1–5. Alternatively, the surfaces 50, 52 can be defined by one or more substantially flat portions defined by relatively sharp angles as long as the surfaces are capable of camming against one another when brought together as described above.

The pawl 16 and the lock 12 can be oriented with respect to one another and shaped to provide the above-described camming action when the handle 14 is fully actuated and/or when the handle 14 is only partially actuated through any desired range of motion. For example, in certain applications it may be desirable to permit the camming motion to unlatch the latch only when the handle 14 is fully actuated when the lock 12 is moved to its unlocked position as shown in FIG. 5. In such cases, the cam surface 52 of the cam 44 can be oriented to present a steeper angle with respect to the cam surface 50 of the pawl 16 when the handle 14 is not actuated, but to still present enough of an angle with respect to the cam surface 50 of the pawl 16 to cam against and push the pawl 16 when the handle 14 is fully actuated. In other applications, it may be desirable to permit the camming motion only when the handle 14 is partially actuated when the lock 12 is moved to its unlocked position as shown in FIG. 5. In such cases, the lock 12 can be mounted in a higher position (as viewed in FIGS. 1–5) so that when the handle 14 is fully actuated, the cam 44 abuts against the side of the pawl 16 rather than against the cam surface 50 thereof. Most preferably, the unlatching camming motion is enabled at any partially or fully-actuated position of the handle 14, in which case the shapes of the cam surfaces 50, 52 are preferably sufficiently beveled, blunted, bowed, chamfered, rounded, sloped, or present a sufficiently shallow angle with respect to one another through the entire range of motion of the handle 14.

It should be noted that the camming motion described above need not necessarily fully move the pawl 16 to its unlatched position. For example, where the handle 14 is only partially actuated when the lock 12 is moved to its unlocked position, it may be necessary to actuate the handle 14 further to sufficiently move the pawl 16 to unlatch the latch. Also, the unlatching camming motion between the cam 44 and the pawl 16 can occur during simultaneous actuation and motion of the handle 14 and the lock 12 and can preferably occur in a range of actuated positions of the handle 14.

Although the handle 14 and lock 12 are preferably mounted for rotation in a manner as described above, other mounting alternatives and manners of motion are possible and fall within the spirit and scope of the present invention. For example, rather than employ a two member articulated lock 12 as described above and shown in FIGS. 1–5, the lock 12 can be a non-articulated element coupled to an actuator for sliding or translational movement toward and away from the pawl 16 in much the same manner as described above. In such an arrangement, the non-articulated element would preferably be mounted in a conventional manner for at least limited rotational movement to follow the handle 14 in its path of motion. As another example, the handle 14 can be mounted for translational movement or for a combination of translation and rotation with respect to the pawl 16. Specifically, the handle 14 can be mounted for movement through any path in which the aperture 42 therein moves the cam 44 toward the pawl 16 when the handle 14 is actuated with the lock 12 in its unlocked position. One having ordinary skill in the art will appreciate that this movement need not necessarily be purely rotational as illustrated in FIGS. 1–5, and can instead be through any path desired.

A second preferred embodiment of the present invention is illustrated in FIGS. 6–10. The second preferred embodiment has a number of features and elements in common with the first preferred embodiment. In this regard, elements of the second preferred embodiment corresponding to elements in the first preferred embodiment have been assigned corresponding reference numerals in the 100 series. With the exception of the differences noted below between the latch assemblies 10, 110 of the first and second preferred embodiments, reference is made to the disclosure of the first preferred embodiment for information regarding the structure, connection, and operation of the latch assembly 110.

The pawl 116 and handle 114 of the latch assembly 110 each have an aperture (154, 156, respectively) within which the cam 144 is movable by movement of the lock 112. The apertures 154, 156 are preferably recesses in the pawl 116 and handle 114. As shown in FIGS. 6–10, the lock 112 is preferably articulated, is mounted for rotation, and can be driven in a similar manner as described above with reference to the first preferred embodiment.

Figure 6:
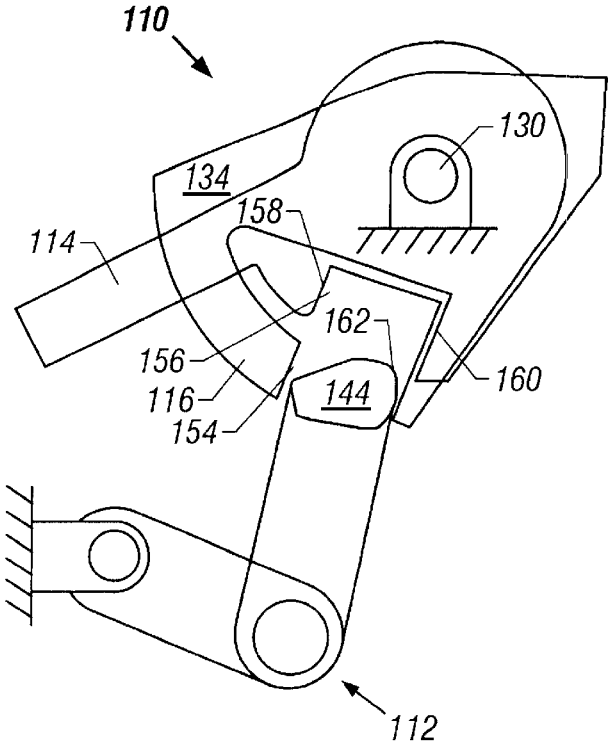
FIG. 6 is an elevational view of a latch assembly according to a second preferred embodiment of the present invention, shown with the latch assembly in a locked state and with the handle in an unactuated position.
Figure 7:
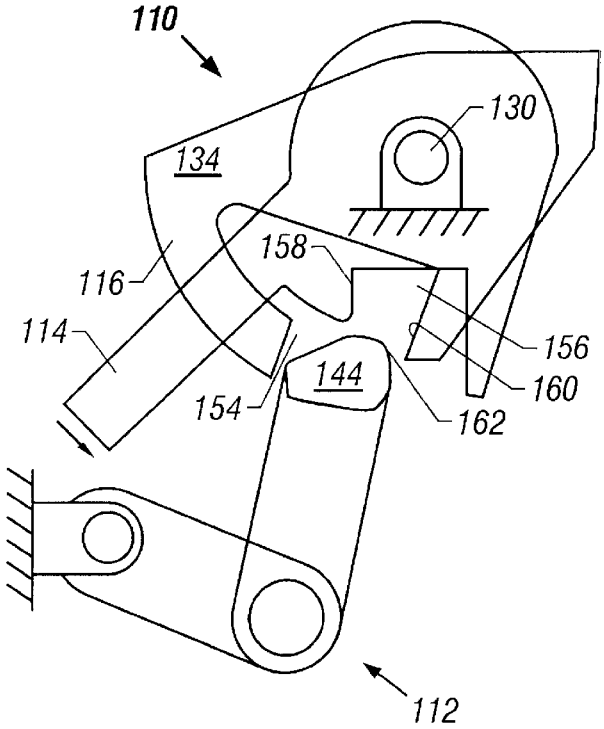
FIG. 7 is an elevational view of the latch assembly illustrated in FIG. 6, shown with the latch assembly in a locked state and with the handle in an actuated position.

When the lock 112 is in its locked position as shown in FIG. 6, the cam 144 is preferably positioned within the aperture 154 of the pawl 116 but not within the aperture 156 of the handle 114. Therefore, actuation of the handle 114 as shown in FIG. 7 (e.g., rotated by actuation of a user-manipulatable device or element connected thereto) when the lock 112 is in the locked position generates no movement of the cam 144 and lock 112, or at least generates insufficient cam and lock movement to move the pawl 116 to its unlatched position as described in more detail below.

Figure 8:
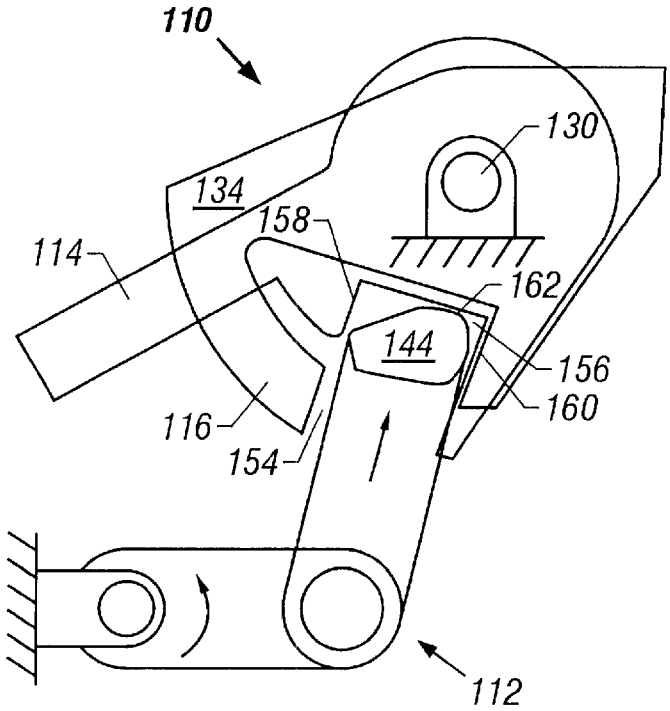
FIG. 8 is an elevational view of the latch assembly illustrated in FIGS. 6 and 7, shown with the latch assembly in an unlocked state and with the handle in an unactuated position.
Figure 9:
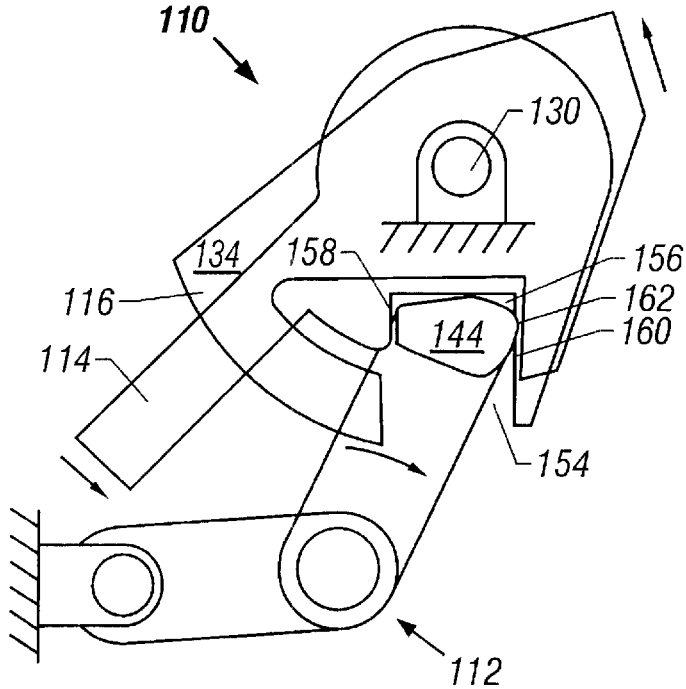
FIG. 9 is an elevational view of the latch assembly illustrated in FIGS. 6–8, shown with the latch assembly in an unlocked state and with the handle in an actuated position.

When the lock 112 is in its unlocked position as shown in FIG. 8, the cam 144 is preferably positioned within the apertures 154, 156 of the pawl 116 and handle 114. Therefore, when the handle 114 is actuated as shown in FIG. 9, at least one surface 158 of the handle aperture 156 contacts and exerts force against the cam 144, thereby forcing the cam 144 against at least one surface 160 of the pawl aperture 154 to move the pawl 116 toward its unlatched position.

Figure 10:
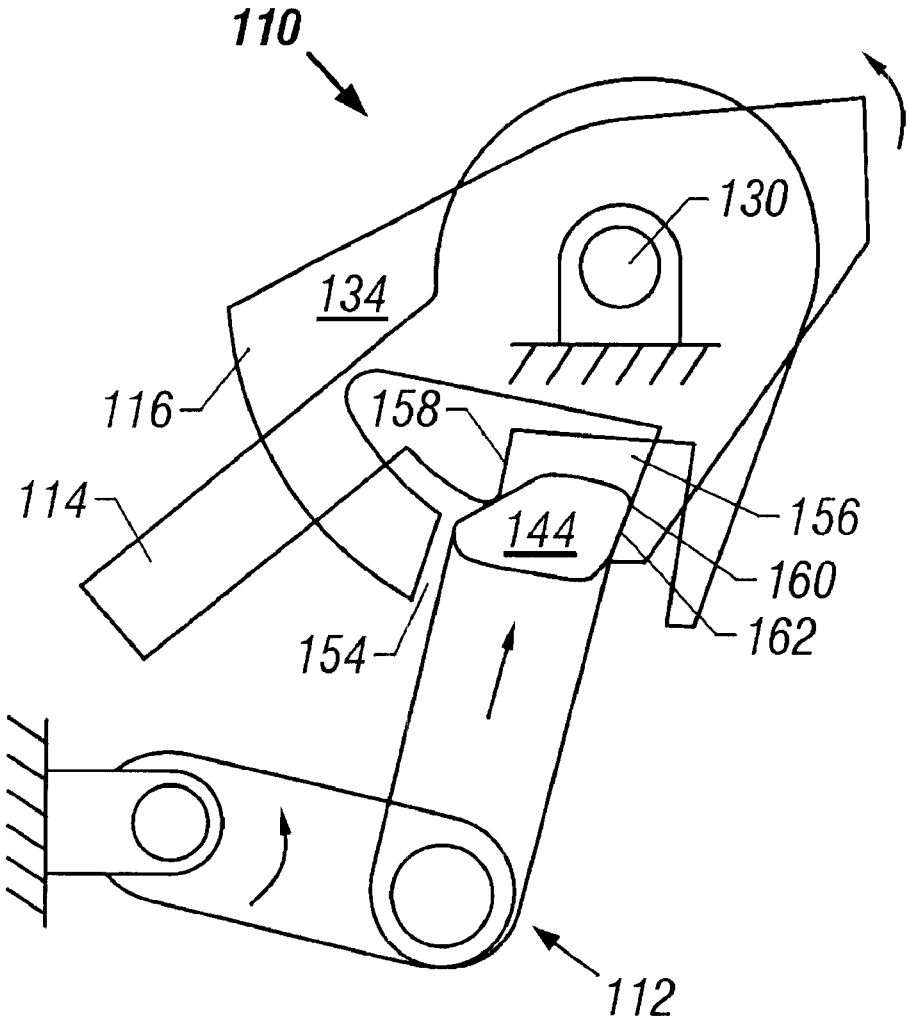
FIG. 10 is an elevational view of the latch assembly illustrated in FIGS. 6–9, shown with the handle in an actuated position and with the pawl being cammed toward its unlatched position.

As with the latch assembly 10 of the first preferred embodiment described above, the latch assembly 110 can properly respond to actuation of the lock 112 toward its unlocked position after the handle 114 has been actuated. When the handle 114 is first actuated as shown in FIG. 7, subsequent actuation of the lock 112 toward its unlocked position preferably brings the cam 144 into contact with the handle 114 as shown in FIG. 10. The handle 114 has a surface against which the cam 144 moves as the lock 112 is driven to its unlocked position. This motion of the cam 144 against the handle 114 is a camming motion, and is preferably enabled by a sloped shape of the cam 144 brought into contact with a surface of the handle aperture 156. The camming surface of the cam 144 can instead be beveled, blunted, bowed, chamfered, rounded, or otherwise shaped to permit smooth camming motion of the cam 144 against the handle 114. The cam 144 cams against the handle 114, thereby forcing the cam 144 into the aperture 156 of the handle 114. As the cam 144 is moved into the handle aperture 156, a surface 162 of the cam 144 cams against the surface 160 of the pawl aperture 154 and forces the pawl 116 to move in response thereto. The pawl 116 preferably rotates about pawl pivot 130 toward its unlatched position. The contact between the cam 144 and the pawl 116 is a camming contact, and is enabled by the relative orientations of the cam and pawl surfaces 162, 160 as the cam 144 is brought into contact with the surface 160 of the pawl aperture 154. Specifically, the surface 162 of the cam 144 is preferably at a shallow angle with respect to the surface 160 of the pawl aperture 154 upon contact. The cam 144 can be beveled, blunted, bowed, chamfered, rounded, sloped, or otherwise shaped to establish this relationship, if desired. When a user actuates a locked door handle 114, the lock 112 will therefore unlatch the latch upon being actuated to its unlocked position, and does so without requiring the user to release and re-actuate the handle 114.

The camming action between the cam 144 and the handle 114 and pawl 116 is preferably a sliding motion of the cam 144 against surfaces 158, 160 of the handle 114 and pawl 116. Any cam, pawl, and handle shape permitting such camming action to force the cam 144 between the surfaces 158, 160 of the handle 114 and pawl 116 can be employed and falls within the spirit and scope of the present invention.

As with the first preferred embodiment above, the cam 144, handle 114, and pawl 116 are selected so that the above-described camming motion between the cam 144 and the handle 114 and pawl 116 occurs at any degree of actuation of the handle 114. For example, where the handle 114 is only actuated a slight amount, movement of the cam 144 (via the lock 112) to its unlocked position can move the pawl 116 a small amount insufficient to release the ratchet 20, whereby further actuation of the handle 114 is needed to release the ratchet 20. As another example, where the handle 114 is fully actuated, movement of the cam 144 (via the lock 112) to its unlocked position can move the pawl 116 fully to its unlatched position to release the ratchet 20. Any relative positions of the cam 144, handle 114, pawl 116, and their surfaces 162, 158, 160 can be selected to produce varying unlatching responsiveness to handle actuation as described above with reference to the first preferred embodiment. Preferably however, camming motion to move the pawl 116 occurs at least in a range of handle positions, and most preferably in any partially or fully actuated position of the handle 114.

A significant difference between the first and second preferred embodiments is the relationship between the cams 44, 144 and the apertures 42, 154, 156 within which they move. Preferably, the apertures 154, 156 of the pawl 116 and the handle 114 are open to the peripheral surfaces of the pawl 116 and handle 114 as shown in FIGS. 6–10. This type of aperture can therefore permit the cam 144 to enter and exit the apertures 154, 156 of the pawl 116 and handle 114, if desired (although the preferred range of cam motion is shown in the figures, whereby the cam 144 never leaves the pawl aperture 154 but can be moved into and out of the handle aperture 156 by movement of the lock 112). Among other things, the second preferred embodiment demonstrates that the cam of any embodiment can be movable through closed or open apertures as desired. In this regard, either or both apertures 154, 156 of the second preferred embodiment can be closed if desired (apertures fully within their respective elements), and can take any shape provided that the cam 144 is movable via camming against a surface of the pawl 116 in at least one partially or fully actuated position of the handle 114 when the cam 144 is moved toward its unlocked position.

One having ordinary skill in the art will appreciate that the camming motion between the cam 144 and the surface 158 of the handle 114 is not required to practice the present invention (although it is preferred in some embodiments such as in the second preferred embodiment). Depending at least in part upon the relative orientations of the lock 112, cam 144, handle aperture 156, and pawl aperture 154, and the angle at which the lock 112 introduces the cam 144 to the handle and pawl apertures 156, 154, the cam 144 can cam against the aperture surface 160 of the pawl 116 without camming against the aperture surface 158 or any other surface of the handle 114. In other words, the lock 112 can force the cam 144 directly against the aperture surface 160 of the pawl 116 to move the pawl 116 as described above. This is also true for the other embodiments of the present invention (e.g., for the first preferred embodiment described above and illustrated in FIGS. 1–5). Also, the first preferred embodiment can employ open or closed apertures in either or both the handle 14 and the pawl 16 while still operating in the same manner described above: camming the cam 44 against a surface of the pawl 16 to move the pawl 16 toward its unlatched position even after partial or full actuation of the handle 14. In one example, the cam 44 is received and is movable within a closed aperture in the handle 14 and a closed aperture in the pawl 16, and is movable into different locations in these apertures by movement of the lock 12 to which it is attached. If the lock 12 is actuated to its unlocked position after and while the handle 14 has been partially or fully actuated, the cam 44 rides (cams) upon and along aperture surfaces of the pawl 16 and handle 14 to move the pawl 16 toward its unlatched position.

It should be noted that camming motion described herein need not necessarily be between a cam and a surface of the pawl. Although the cams 44, 144 of both the first and second preferred embodiments preferably cam against surfaces of the pawl 16, 116 and handle 14, 114 to move the pawl 16, 116 toward its unlatched position (and as described above, can generate such pawl movement even without camming against the handle 14, 114), the cam in other preferred embodiments cams only against the handle to move the pawl in this manner. An example of such an arrangement is provided by the third preferred embodiment of the present invention as shown in FIGS. 11–15. Also, by using the term "cammed" in any of its forms (e.g., "camming", to "cam", and the like), the elements being cammed do not necessarily have to contact one another. Instead, physical contact can occur between one or more other elements connected to the elements being "cammed". For example, the cam 44, 144 need not necessarily physically contact the pawl 16, 116 in its camming motion thereagainst. Instead, one or more wear strips, pads, inserts, or other elements can be connected to the cam 44, 144 and/or pawl 16, 116 to physically prevent direct contact of the cam 44, 144 against the pawl 16, 116 during camming.

In the latch assembly 210 of the third preferred embodiment, the handle 214 and pawl 216 are preferably mounted for rotation in any conventional manner about respective pivots 264, 266 (although they can be mounted for rotation about the same pivot in alternative embodiments). The handle 214 and pawl 216 can be pivotably mounted in a number of other conventional manners as described above with reference to the handles 14, 114 and pawls 16, 116 of the first and second preferred embodiments.

The lock 212 is rotatably coupled to the pawl 216 in any conventional manner, such as about a pivot 268 received within apertures in the pawl 216 and lock 212, about a member extending from or connected to the pawl 216, about an element integral with or connected to the lock 212 and extending within a mating aperture in the pawl 216, about a ball and socket-type joint between the pawl 216 and lock 212, about a hinge joint between these elements, and the like. The lock 212 also has a cam 244 thereon which is preferably an extension of the lock 212 but which can take any form and be connected to the lock 212 in any conventional manner as described above with reference to the cams 44, 144 of the first and second preferred embodiments.

The handle 214 and lock 212 are each preferably attached to handle and lock inputs of the latch. Specifically, a lever or other user-manipulatable device is preferably directly or indirectly coupled to the handle 214 for actuation thereof by a user, while the lock 212 is preferably directly or indirectly coupled to an actuator or to a user-manipulatable device for rotating the lock 212. The lock 212 can be actuated by a number of conventional devices and mechanisms, including without limitation actuators, electromagnets on the lock 212 and on the handle 214, a latch housing wall, or any other latch structure adjacent to the lock 212, a mechanical linkage hinged to the lock 212, and the like. The lock 212 can therefore be pivoted with respect to the pawl 216 either automatically or manually in a number of manners well known to those skilled in the art, and the handle 214 can be pivoted in response to a mechanical, electro-mechanical, or electrical connection to a lever or other user-manipulatable device for unlatching the latch.

Figure 11:
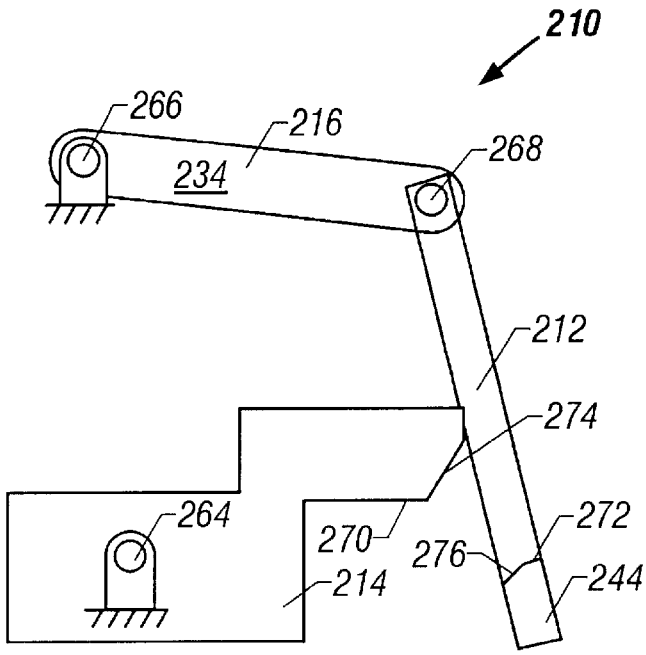
FIG. 11 is an elevational view of a latch assembly according to a third preferred embodiment of the present invention, shown with the latch assembly in a locked state and with the handle in an unactuated position.
Figure 12:
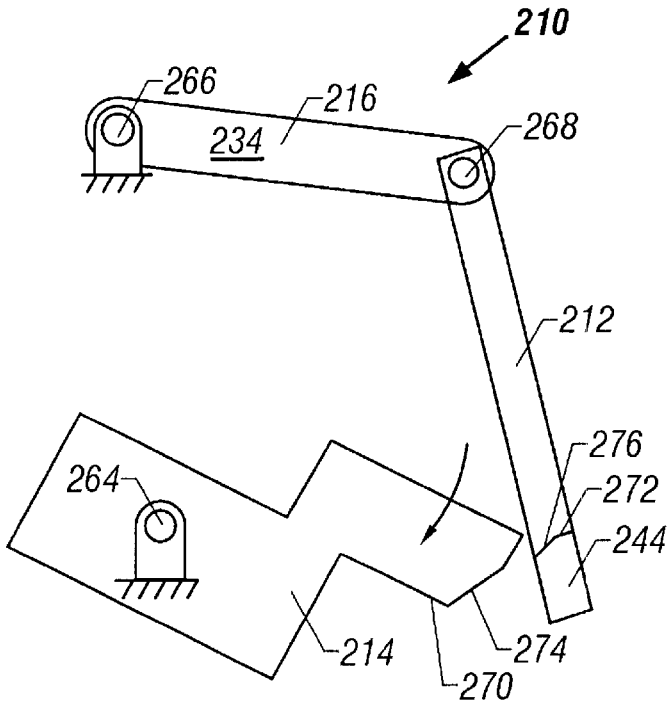
FIG. 12 is an elevational view of the latch assembly illustrated in FIG. 11, shown with the latch assembly in a locked state and with the handle in an actuated position.

To place the latch assembly 210 in a locked state, the lock 212 is moved to a position in which actuation of the handle 214 does not cause motion of the lock 212, or at least generates insufficient motion to move the pawl 216 to its unlatched position. With reference to FIG. 11, the lock 212 is preferably swung about its pivot connection on the pawl 216 to a position in which the cam 244 is removed from the handle 214. In this position, actuation of the handle 214 preferably results in no contact with the cam 244 (or less preferably, contact that is insufficient to transmit enough force to move the pawl 216 to its unlatched position). Such handle actuation is shown in FIG. 12. Accordingly, the latch assembly 210 of FIGS. 11 and 12 is in a locked state.

Figure 13:
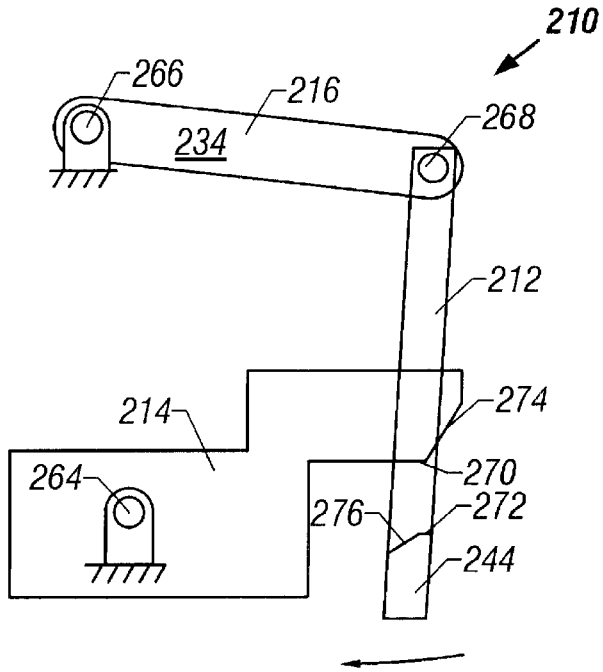
FIG. 13 is an elevational view of the latch assembly illustrated in FIGS. 11 and 12, shown with the latch assembly in an unlocked state and with the handle in an unactuated position.
Figure 14:
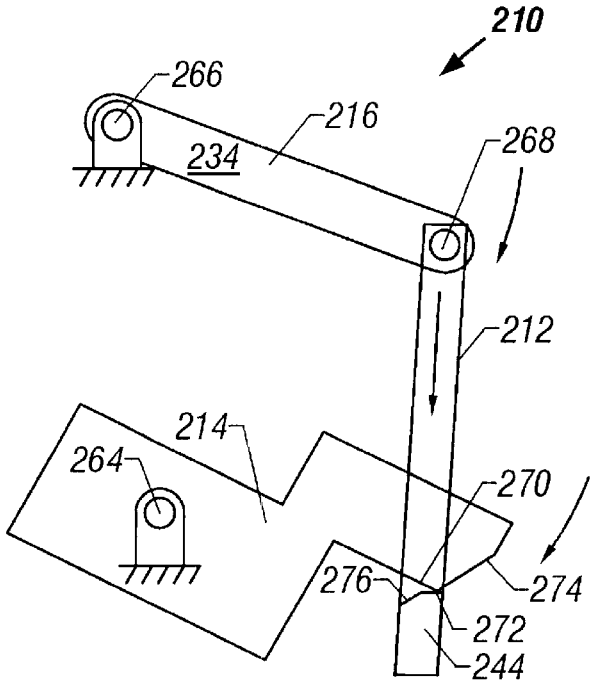
FIG. 14 is an elevational view of the latch assembly illustrated in FIGS. 11–13, shown with the latch assembly in an unlocked state and with the handle in an actuated position.

To place the latch assembly 210 in an unlocked state, the lock 212 is moved to a position in which actuation of the handle 214 causes sufficient motion of the lock 212 to move the pawl 216 and to release the ratchet 20. With reference to FIG. 13, the lock 212 is preferably swung about its pivot connection to the pawl 216 to a position in which the handle 214 will act against the cam 244 when the handle 214 is actuated. Specifically, the handle 214 preferably has at least one surface 270 that moves into contact with at least one surface 272 of the cam 244. Therefore, by actuating the handle 214, the surface 270 of the handle 214 presses against the surface 272 of the cam 244 and causes the cam 244 to move, thereby causing the lock 212 to rotate the pawl 216 and to release the ratchet 20.

Figure 15:
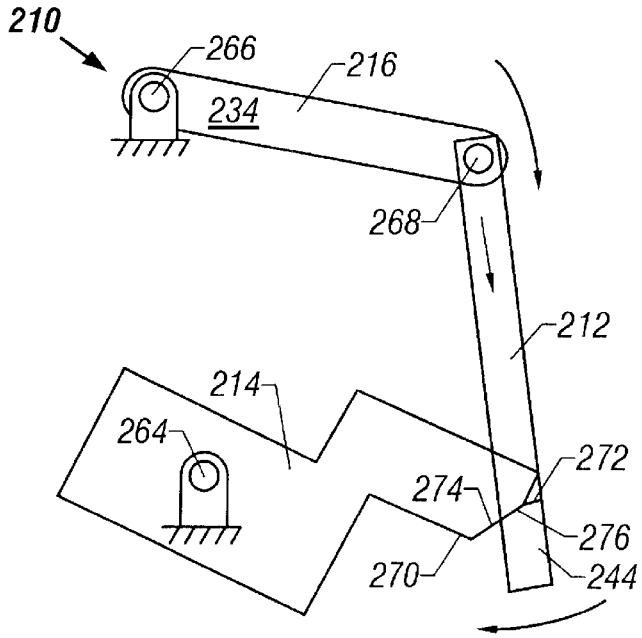
FIG. 15 is an elevational view of the latch assembly illustrated in FIGS. 1–4, shown with the handle in an actuated position and with the cam being cammed against the handle to rotate the pawl toward its unlatched position.

With reference to FIG. 15 of the third preferred embodiment, the latch assembly 210 can properly respond to actuation of the lock 212 toward its unlocked position after the handle 214 has been actuated. When the handle 214 is first actuated as shown in FIG. 12, subsequent actuation of the lock 212 toward its unlocked position brings the cam 244 into camming contact with the handle 214 as shown in FIG. 15. The cam 244 has at least one surface 276 against which the handle 214 moves as the lock 212 is moved to its unlocked position. This motion is a camming motion, and is enabled by sloped handle and cam surfaces 274, 276 brought into contact with one another when the handle 214 and lock 212 are brought together. The cam 244 cams against the handle 214 and thereby forces the pawl 216 to move toward its unlatched position. When a user actuates a locked door handle 214, the lock 212 will therefore unlatch the latch upon being actuated to its unlocked position, and does so without requiring the user to release and re-actuate the handle 214.

The camming action between the handle 214 and the cam 244 is preferably a sliding motion of the handle and cam surfaces 274, 276 against one another. At least a portion of these surfaces 274, 276 are preferably brought together at a shallow angle to better enable the camming action. The surfaces can therefore be beveled, blunted, bowed, chamfered, rounded, or sloped as shown in FIGS. 11–15. Alternatively, the surfaces can be defined by one or more substantially flat portions defined by relatively sharp angles as long as the surfaces are capable of camming against one another when brought together as described above.

As with the first and second preferred embodiments above, the positions of the cam 244, handle 214, and lock 212 are selected so that the above-described camming motion between the cam 244 and the handle 214 occurs at any degree of actuation of the handle 214. For example, where the handle 214 is only actuated a slight amount, movement of the cam 244 (via the lock 212) to its unlocked position can move the pawl 216 a small amount insufficient to release the ratchet 20, whereby further actuation of the handle 214 is needed to release the ratchet 20. As another example, where the handle 214 is fully actuated, movement of the cam 244 (via the lock 212) to its unlocked position can move the pawl 216 fully to its unlatched position to release the ratchet 20. Any relative positions of the cam 244, handle 214, and their surfaces 276, 274 can be selected to produce varying unlatching responsiveness to handle actuation as described above with reference to the first and second preferred embodiments. Preferably however, camming motion to move the pawl 216 occurs at least in a range of handle positions, and most preferably in any partially or fully actuated position of the handle 214.

In the third preferred embodiment of the present invention, the cam 244 cams against at least one surface 274 of the partially or fully-actuated handle 214 to move the pawl 216 toward its unlatched position. This is in contrast to the camming motion of the cam 44, 144 against both the pawl 16, 116 and the handle 14, 114 described in the earlier preferred embodiments, and in contrast to camming motion of the cam 44, 144 only against the pawl 16, 116 (also described above) to perform this same function. Accordingly, the cam 44, 144, 244 of the present invention can be positioned via the lock 12, 112, 212 to cam against the pawl 16, 116, 216, the handle 14, 114, 214, or both the pawl 16, 116, 216 and handle 14, 114, 214 to generate movement of the pawl 16, 116, 216 toward its unlatched position at a partially or fully-actuated position of the handle 14, 114, 214 as desired. This camming action of the cam 44, 144, 244 can be against a surface of a closed or open aperture in either or both the handle 14, 114, 214 and pawl 16, 116, 216 and/or can be against an exterior surface of either or both the handle 14, 114, 214 and pawl 16, 116, 216. In all cases, the pawl 16, 116, 216 is moved toward its unlatched position without requiring the user to release and re-actuate the handle 14, 114, 214.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims. For example, the various shapes of the pawl 16, 116, 216, handle 14, 114, 214, and lock 12, 112, 212 illustrated in FIGS. 1–15 are presented by way of example only and can be significantly different without departing from the spirit and scope of the present invention. The different possible shapes are defined at least in part by the functions of the elements described above (e.g., still having cam surfaces for camming motion as described, still movable to interact with each other as described, etc.). Also, each of the elements of the preferred embodiments can be made from any resilient material desired, including without limitation steel, powdered metal, aluminum, iron, and other metals, plastic, fiberglass, composites, refractory materials, and any combination thereof.

As another example, each of the latch assembly embodiments described above and illustrated in the figures employs a cam 44, 144, 244 having a locked position and an unlocked position. When the cam 44, 144, 244 has already been actuated to its unlocked position, the surfaces of the handle 14, 114, 214 and/or pawl 16, 116, 216 against which the cam 44, 144, 244 acts are not necessarily the same surfaces against which the cam 44, 144, 244 cams when the lock 12, 112, 212 is actuated to its unlocked position after the handle 14, 114, 214 has been partially or fully actuated. Similarly, different surfaces of the cam 44, 144, 244 can be contacted by the pawl 16, 116, 216 (and handle 14, 114, 214 in some embodiments) in different initial positions of the handle 14, 114, 214. It should be noted, however, that the pawl surface against which the cam 44, 144, 244 acts when already in its unlocked position can be the same surface against which the cam 44, 144, 244 cams when not already in its unlocked position. This is also true for those handle surfaces against which the cam 44, 144, 244 acts.

As used herein and in the appended claims, the terms "camming contact" and "camming motion" refer to contact and motion, respectively, of one element against or upon another to impart movement to an element. The types of contact and motion include rolling, pressing, pushing, and sliding (or any combination thereof). In some highly preferred embodiments of the present invention, "camming contact" and "camming motion" refers to a pressing movement of one element against another, and more preferably to a combination of sliding and pressing movement of one element against another. Camming contact and camming motion preferably exist when the cam 44, 144, 244 is moved to its unlocked position after the handle 14, 114, 214 has been actuated at least to some minimum amount.

I claim:

1. A latch assembly, comprising:

a pawl movable between a latched position and an unlatched position;

a handle lever having at least one partially actuated position;

a cam;

a lock lever coupled to the cam for moving the cam through a range of positions with respect to the pawl and handle lever, including:

an unlocked position in which the cam is capable of transmitting motive force from the handle lever to the pawl to move the pawl to the unlatched position; and a locked position in which the cam is incapable of transmitting sufficient motive force from the handle lever to the pawl to move the pawl to the unlatched position;

wherein movement of the lock lever to the unlocked position in at least one of the partially actuated positions of the handle lever generates camming contact of the cam against at least one of the pawl and the handle lever to move the pawl to the unlatched position.

2. The latch assembly as claimed in claim 1, wherein the handle lever has a user-operable device for user actuation of the handle lever.

3. The latch assembly as claimed in claim 1, wherein the cam is an elongated element extending from the lock lever.

4. The latch assembly as claimed in claim 1, wherein the pawl is movable to the unlatched position via camming contact of a surface of the handle lever against the cam and camming contact of the cam against the pawl.

5. The latch assembly as claimed in claim 4, wherein the surface of the handle lever is a surface of an aperture defined in the handle lever and within which the cam is received.

6. The latch assembly as claimed in claim 1, wherein the pawl is movable to the unlatched position via camming contact of the cam against the pawl in a fully actuated position of the handle lever.

7. The latch assembly as claimed in claim 1, wherein the cam is received within an aperture defined in the handle lever and is movable within the aperture responsive to actuation of the handle lever and responsive to movement of the lock lever.

8. The latch assembly as claimed in claim 1, wherein the lock lever includes a pair of members pivotably coupled to one another, coupled at one end to the cam and coupled at another end for pivotal movement relative to the pawl and handle lever.

9. The latch assembly as claimed in claim 1, wherein the cam is received within an aperture defined in the pawl and an aperture defined in the handle lever.

10. The latch assembly as claimed in claim 9, wherein the camming contact is between the cam and a wall of the aperture in the pawl.

11. The latch assembly as claimed in claim 10, wherein the pawl is movable to the unlatched position via camming contact of a surface of the aperture in the handle lever against the cam and camming contact of the cam against the pawl.

12. The latch assembly as claimed in claim 1, wherein the camming contact is between the cam and a peripheral surface of the pawl.

13. The latch assembly as claimed in claim 12, wherein the cam is received and movable within an aperture defined in the handle lever and wherein the pawl is movable to the unlatched position via camming contact of a surface of the aperture against the cam and camming contact of the cam against the pawl.

14. A latch assembly, comprising:

a pawl movable between a latched position and an unlatched position;

a lock lever coupled to the pawl;

a cam coupled to the lock lever;

a handle lever having at least one partially actuated position, the cam movable by the lock lever through a range of positions including:

an unlocked position in which the handle lever is capable of transmitting motive force through the cam and lock lever to the pawl to move the pawl to the unlatched position; and a locked position in which the handle lever is incapable of transmitting sufficient motive force through the cam and lock lever to the pawl to move the pawl to the unlatched position;

wherein the lock lever is movable via camming contact of the cam against the handle lever in at least one of the partially actuated positions of the handle lever to drive the pawl to the unlatched position.

15. The assembly as claimed in claim 14, wherein the lock lever has at least two articulated members coupled at one end to the cam and pivotally coupled at another end for rotation about a fixed point relative to the pawl and handle lever.

16. The assembly as claimed in claim 14, wherein the cam is an elongated element extending from the lock lever.

17. The assembly as claimed in claim 14, wherein the handle lever includes a user-manipulatable element for actuating the handle lever.

18. The assembly as claimed in claim 14, wherein the handle lever is movable to a fully actuated position, and wherein the lock lever is movable via camming contact of the cam against the handle lever in the fully actuated position of the handle lever to drive the pawl to the unlatched position.

19. The assembly as claimed in claim 14, wherein the lock lever is pivotably coupled to the pawl and is pivotable with respect to the handle lever to bring the cam into and out of camming contact with the handle lever.

20. The assembly as claimed in claim 14, wherein the pawl is movable to the unlatched position via camming contact of the cam between and against at least one surface of the pawl and at least one surface of the handle lever.

21. The assembly as claimed in claim 20, wherein the cam is received and movable within an aperture defined in the handle lever, and wherein the at least one surface of the handle lever is at least one surface of the aperture.

22. The assembly as claimed in claim 20, wherein:

the cam is received and movable within apertures defined in the handle lever and pawl;

the at least one surface of the handle lever is at least one surface of the aperture in the handle lever; and the at least one surface of the cam is at least one surface of the aperture in the cam.

23. A method of unlatching a latch assembly, comprising:

positioning a pawl in a latched position;

moving a handle lever toward a partially actuated position;

moving a lock lever while the handle lever is at least partially actuated, the lock lever having a cam coupled thereto;

camming the cam against the pawl by movement of the lock lever while the handle lever is partially actuated; and moving the pawl from the latched position to an unlatched position while the handle lever is partially actuated by the step of camming the cam against the pawl.

24. The method as claimed in claim 23, wherein:

the lock lever has first and second elements pivotably coupled together; and moving the lock lever includes pivoting the first element about a pivot point fixed relative to the pawl and handle lever to pivot the second element with respect to the first element and with respect to the handle lever.

25. The method as claimed in claim 23, wherein camming the cam against the pawl and moving the pawl via the camming motion occurs also when the handle lever is fully actuated.

26. The method as claimed in claim 23, wherein the cam is an elongated element extending from the lock lever.

27. The method as claimed in claim 23, further comprising moving the cam through an aperture defined in the pawl while camming the cam against the pawl and moving the pawl.

28. The method as claimed in claim 23, further comprising moving the cam through an aperture defined in the handle lever while camming the cam against the pawl and moving the pawl.

29. The method as claimed in claim 23, further comprising moving the cam through apertures defined in the handle lever and pawl while camming the cam against the pawl and moving the pawl.

30. The method as claimed in claim 23, further comprising camming the cam against the handle lever; wherein moving the pawl includes camming the cam against and between surfaces of the handle lever and pawl.

31. The method as claimed in claim 30, wherein the surface of the handle lever is a surface of an aperture defined in the handle lever and within which the cam is movably received.

32. The method as claimed in claim 30, wherein the surface of the pawl is a surface of an aperture defined in the pawl and within which the cam is movably received.

33. The method as claimed in claim 32, wherein the surface of the handle lever is a surface of an aperture defined in the handle lever and within which the cam is movably received.

34. A method of unlatching a latch assembly, comprising:

providing a pawl having an unlatched position and a latched position;

moving a handle lever toward a partially actuated position;

moving a lock lever from a locked position toward an unlocked position while the handle lever is partially actuated, the lock lever coupled to a cam and to a pawl;

camming the cam against the handle lever by movement of the lock lever while the handle lever is partially actuated; and moving the pawl from the latched position to the unlatched position via camming motion of the cam against the handle lever while the handle lever is partially actuated.

35. The method as claimed in claim 34, wherein:

the lock lever has a pivotable joint; and moving the lock lever includes pivoting one element of the lock lever about a pivot point and with respect to another element of the lock lever.

36. The method as claimed in claim 34, wherein the lock lever is coupled to the handle lever via the cam.

37. The method as claimed in claim 34, wherein the cam is movable into and out of contact with the handle lever via movement of the lock lever.

38. The method as claimed in claim 37, wherein the lock lever is pivotably coupled to the pawl for movement toward and away from the handle lever.

39. The method as claimed in claim 34, further comprising camming the cam against the pawl, wherein the pawl is moved from the latched position to the unlatched position via camming motion of the cam against and between the handle lever and the pawl.

40. The method as claimed in claim 39, wherein:

the cam is movably received within an aperture defined in the pawl; and the pawl is moved from the latched position to the unlatched position via camming motion of the cam against and between the handle lever and at least one surface of the aperture in the pawl.

41. The method as claimed in claim 39, wherein:

the cam is movably received within an aperture defined in the handle lever; and the pawl is moved from the latched position to the unlatched position via camming motion of the cam against and between the pawl and at least one surface of the aperture in the handle lever.

42. The method as claimed in claim 41, wherein:

the cam is also movably received within an aperture defined in the pawl; and the pawl is moved from the latched position to the unlatched position via camming motion of the cam against and between at least one surface of the aperture in the handle lever and at least one surface of the aperture in the pawl.

* * * * *